US012680741B2

(12) United States Patent
Kawabe et al.

(10) Patent No.: US 12,680,741 B2
(45) Date of Patent: Jul. 14, 2026

(54) AIR CONDITIONER

(71) Applicant: Panasonic Intellectual Property Management Co., Ltd., Osaka (JP)

(72) Inventors: Yoshikazu Kawabe; Seishi Iitaka, Shiga (JP); Akira Hiwata, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 105 days.

(21) Appl. No.: 18/699,277

(22) PCT Filed: Oct. 14, 2022

(86) PCT No.: PCT/JP2022/038334
§ 371 (c)(1),
(2) Date: Apr. 6, 2024

(87) PCT Pub. No.: WO2023/068188
PCT Pub. Date: Apr. 27, 2023

(65) Prior Publication Data

US 2025/0093082 A1 Mar. 20, 2025

(30) Foreign Application Priority Data

Oct. 22, 2021 (JP) ..... 2021-172837

(51) Int. Cl.
*F25B 41/42* (2021.01)
*F25B 49/02* (2006.01)

(52) U.S. Cl.
CPC ..... *F25B 41/42* (2021.01); *F25B 49/02* (2013.01); *F25B 2400/0409* (2013.01);
(Continued)

(58) Field of Classification Search
CPC .. F25B 41/42; F25B 49/02; F25B 2400/0409; F25B 2400/121; F25B 2700/21162; F25B 2700/2117
See application file for complete search history.

(56) References Cited

U.S. PATENT DOCUMENTS

2010/0180612 A1* 7/2010 Kasahara ..... F25B 40/00 62/434
2019/0367789 A1* 12/2019 Rached ..... C09K 5/045
2021/0269693 A1 9/2021 Itano et al.

FOREIGN PATENT DOCUMENTS

JP 8-005185 1/1996
JP 2002-349976 12/2002
(Continued)

OTHER PUBLICATIONS

International Search Report of PCT application No. PCT/JP2022/038334 dated Dec. 6, 2022.

*Primary Examiner* — Larry L Furdge
(74) *Attorney, Agent, or Firm* — HSML P.C.

(57) ABSTRACT

Provided are branch part (103) that distributes a refrigerant having flowed out of condenser (104) into main circuit (130) communicating with evaporator (108) and bypass circuit (140) that bypasses evaporator (108), confluence part (112) that merges the refrigerant from main circuit (130) and the refrigerant from bypass circuit (140), first throttle (106) that decompresses and expands the refrigerant between condenser (104) and evaporator (108), first inter-refrigerant heat exchanger (114) that exchanges heat between the refrigerant between condenser (104) and first throttle (106), and the refrigerant between confluence part (112) and suction into compressor (102), second throttle (110) that is disposed in bypass circuit (140), and decompresses and expands the refrigerant distributed at branch part (103), and second inter-refrigerant heat exchanger (111) that is disposed in bypass circuit (140) and exchanges heat between the refrigerant decompressed and expanded by second throttle (110) and the refrigerant having flowed out of the condensation-side outlet of first inter-refrigerant heat exchanger (114).

10 Claims, 3 Drawing Sheets

(52) U.S. Cl.
CPC ..... *F25B 2400/121* (2013.01); *F25B 2700/21162* (2013.01); *F25B 2700/2117* (2013.01)

(56) References Cited

FOREIGN PATENT DOCUMENTS

| | | | |
|---|---|---|---|
| JP | 2008-096093 | | 4/2008 |
| JP | 2009-204244 | | 9/2009 |
| JP | 2021-085542 | A | 6/2021 |
| JP | 2021-096057 | A | 6/2021 |
| WO | 2020/017386 | A1 | 1/2020 |

* cited by examiner

AIR CONDITIONER

TECHNICAL FIELD

The present disclosure relates to an air conditioner.

BACKGROUND ART

PTL 1 discloses a cooling device using a non-azeotropic mixed refrigerant. The cooling device includes an outlet pressure detection sensor that detects pressure of the non-azeotropic mixed refrigerant discharged from a compressor, and an outlet temperature detection sensor that detects temperature of the refrigerant. Then, the cooling device causes a calculation device to acquire a saturation temperature of the refrigerant from the refrigerant pressure detected by the outlet pressure detection sensor to acquire a compressor outlet set temperature by adding a correction value to the saturation temperature, and controls a first expansion valve so that a detection value of the outlet temperature detection sensor is identical to the compressor outlet set temperature.

The cooling device in an exemplary embodiment uses an injection compressor that sucks a refrigerant under low pressure or intermediate pressure, an economizer, and a liquid subcooler. The refrigerant is supplied from the economizer to an intermediate-pressure suction port. The refrigerant is supplied from a gas-liquid separator and the liquid subcooler to a low-pressure suction port.

The economizer cools the refrigerant fed from a condenser, and evaporates the refrigerant obtained by decompressing and expanding a part of the cooled refrigerant (by receiving heat from the refrigerant fed from the condenser), and then feeds the evaporated refrigerant to the intermediate-pressure suction port of the compressor.

The remaining liquid refrigerant cooled by the economizer is further cooled by the liquid subcooler to increase in degree of supercooling, and flows to the first expansion valve. The remaining liquid refrigerant is then heated by the evaporator to evaporate and flow to the gas-liquid separator.

A liquid refrigerant separated by the gas-liquid separator evaporates while cooling the liquid refrigerant on a supercooling side using the liquid subcooler. Then, a gaseous refrigerant separated by the gas-liquid separator flows to the injector, and returns to a suction port of the compressor while sucking a gasified refrigerant from an evaporation side of the liquid subcooler.

CITATION LIST

Patent Literature

PTL 1: Unexamined Japanese Patent Publication No. 2002-349976.

SUMMARY OF THE INVENTION

Unfortunately, the injection compressor has a complicated structure, so that the injection compressor is more expensive than a single-stage compressor. Although a conventional example allows a single-stage compressor to be used, the conventional example intends contents related to a pressure sensor, a temperature sensor, and expansion valve control. Thus, configurations of an economizer, a liquid subcooler, and the like are not specifically shown.

The amount of the refrigerant to be evaporated by the economizer is a part of the refrigerant circulating in a device.

Thus, when capacity of the device is reduced, the amount of the refrigerant to be evaporated is extremely reduced to cause difficulty in adjusting a throttle. The liquid subcooler cools the refrigerant under high pressure using the refrigerant having left a main evaporator, so that evaporation temperature is high due to a temperature glide, thereby causing difficulty in securing heat exchange performance from the viewpoint of increasing the degree of supercooling of a liquid refrigerant under high pressure.

The present disclosure provides a device capable of increasing a degree of supercooling of the refrigerant before decompression and expansion by effectively using a heat exchanger that exchanges heat between refrigerants in a refrigeration cycle, and of stabilizing a state of the refrigerant in a compressor suction port.

An air conditioner according to the present disclosure includes: a compressor that compresses a refrigerant; a condenser that exchanges heat between the refrigerant and air fed by a first blower to condense the refrigerant; an evaporator that exchanges heat between the refrigerant and air fed by a second blower to evaporate the refrigerant; a branch part that distributes the refrigerant having flowed out of the condenser into a main circuit communicating with the evaporator and a bypass circuit that bypasses the evaporator; a confluence part that merges the refrigerant from the main circuit and the refrigerant from the bypass circuit; a first throttle that decompresses and expands the refrigerant between the condenser and the evaporator; a first inter-refrigerant heat exchanger that exchanges heat between the refrigerant between the condenser and the first throttle, and the refrigerant between the confluence part and suction into the compressor; a second throttle that is disposed in the bypass circuit, and decompresses and expands the refrigerant distributed at the branch part; and a second inter-refrigerant heat exchanger that is disposed in the bypass circuit and exchanges heat between the refrigerant decompressed and expanded by the second throttle and the refrigerant having flowed out of a condensation-side outlet of the first inter-refrigerant heat exchanger. The bypass circuit causes the refrigerant having flowed from the second inter-refrigerant heat exchanger to flow to the confluence part and merge with the refrigerant having flowed from the evaporator at the confluence part.

The air conditioner according to an aspect of the present disclosure causes a minimum evaporation temperature of the refrigerant under identical evaporation pressure to be lower in the second inter-refrigerant heat exchanger in which the refrigerant evaporates from a liquid state than in the first inter-refrigerant heat exchanger that performs cooling with the refrigerant at the end of evaporation, so that the refrigerant on a high-pressure side can be cooled to a lower temperature. Thus, the configuration of the present disclosure enables the refrigerant on the high-pressure side to be cooled to the lowest temperature. Thus, a high-performance air conditioner can be provided at low cost.

Additionally, the refrigerant on a low-pressure side having flowed out of the second inter-refrigerant heat exchanger acquires an opportunity to absorb heat again in the first inter-refrigerant heat exchanger, so that the liquid refrigerant is prevented from returning from the second inter-refrigerant heat exchanger to the compressor, thereby enabling stable operation. Thus, an air conditioner with high comfort and reliability can be provided.

DESCRIPTION OF EMBODIMENT (Underlying Knowledge and the Like of the Present Disclosure)

As described in the background art, examples of a method for improving efficiency and stability of a refrigeration cycle include a technique of performing heat exchange between circulating refrigerants, such as a liquid subcooler and an economizer.

Well-known examples of the liquid subcooler includes a heat exchanger called an internal heat exchanger that cools a refrigerant having flowed out of a condenser with a refrigerant having flowed out of an evaporator.

Figure 2:
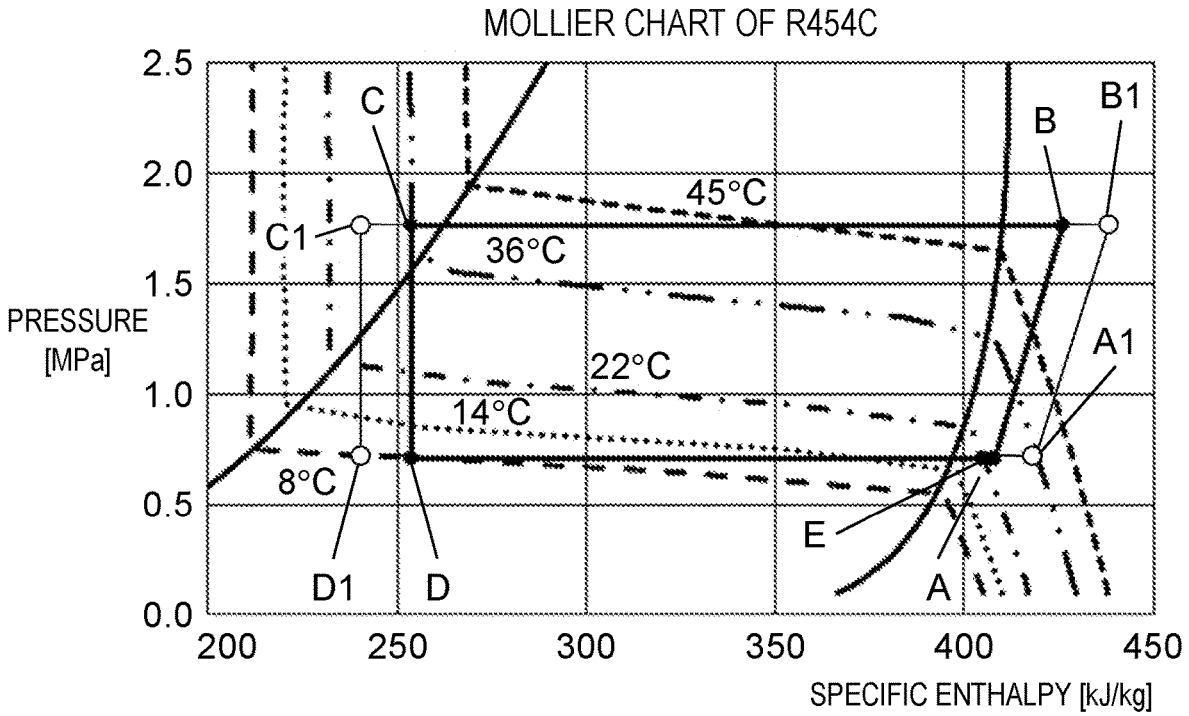
FIG. 2 is a Mollier chart of R454C showing a change when only a first inter-refrigerant heat exchanger is used.

FIG. 2 is a Mollier chart of R454C showing a change when only a first inter-refrigerant heat exchanger is used. A cycle without using the first inter-refrigerant heat exchanger causes a refrigerant to circulate through a state at each of points in order of A→B→C→D→E→A. Specifically, A is a compressor suction, B is a compressor discharge, C is a condenser outlet, D is an evaporator inlet, and E is an evaporator outlet.

When only the first inter-refrigerant heat exchanger is used, heat is exchanged between the refrigerant passing through C and the refrigerant passing through E. Then, the first inter-refrigerant heat exchanger has a condensation-side outlet referred to as C1, an evaporator inlet referred to as D1, a compressor suction referred to as A1, a compressor discharge referred to as B1, and the refrigerant circulates through a state at each of points in order of A1→B1→C→C1→D1→E→A1 to form a cycle.

Then, specific enthalpy difference in the evaporator increases to enable equivalent capacity to be obtained with a small amount of circulation of the refrigerant, so that operation efficiency is improved.

R454C contains R1234yf at a weight ratio of 78.5% to have characteristics with good performance when a degree of superheating of the refrigerant at the compressor suction port increases, so that effect is particularly large when R454C is used as the refrigerant. Alternatively, even a single refrigerant without characteristics such as those of R454C can obtain effect of reducing a pressure loss from the evaporator outlet to the compressor suction port or preventing liquid from returning to the compressor suction port.

Figure 3:
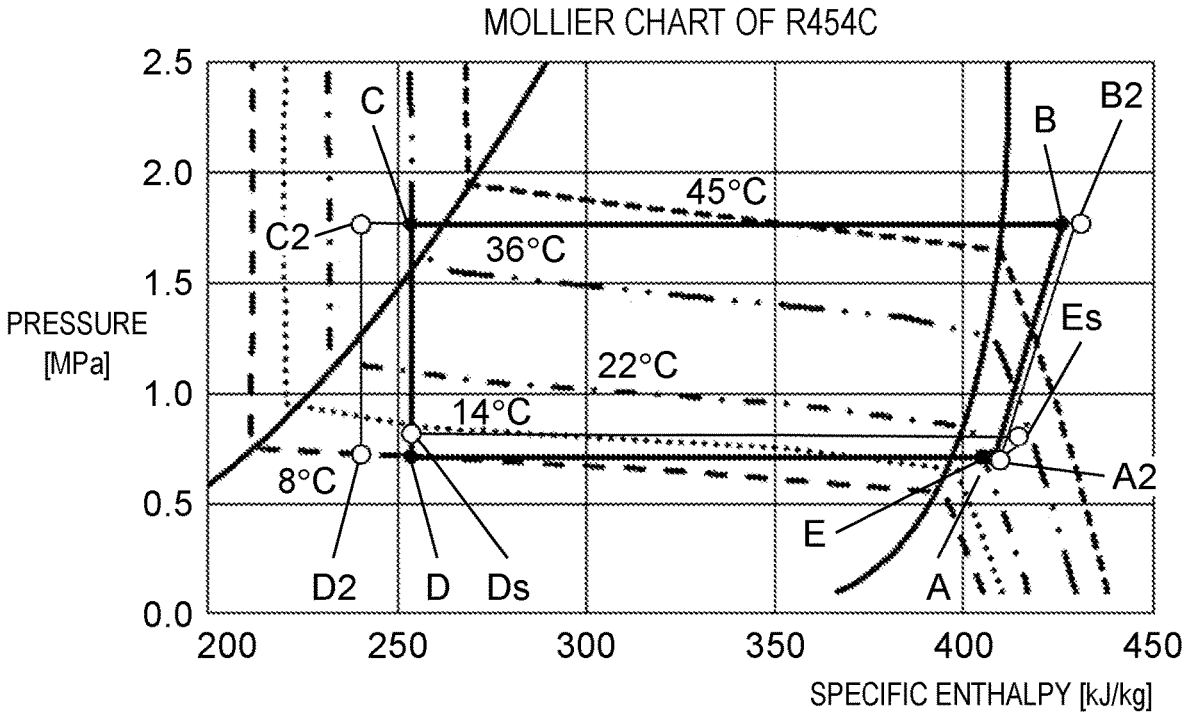
FIG. 3 is a Mollier chart of R454C showing a change when only a second inter-refrigerant heat exchanger is used.

FIG. 3 is a Mollier chart of R454C showing a change when only the second inter-refrigerant heat exchanger is used. A cycle without using the second inter-refrigerant heat exchanger causes a refrigerant to circulate through a state at each of points in order of A→B→C→D→E→A as in FIG. 2.

When only the second inter-refrigerant heat exchanger is used, a part of the refrigerant is decompressed and expanded, the part having passed through C and serving as a sub-refrigerant. The sub-refrigerant is then introduced into an evaporation-side inlet of the second inter-refrigerant heat exchanger in a state of Ds, and is evaporated and taken out from an evaporation-side outlet of the second inter-refrigerant heat exchanger in a state of Es. The sub-refrigerant exchanges heat with a remaining main part of the refrigerant having passed through C, and is cooled by the heat exchange with the main part of the refrigerant and fed out to the condensation-side outlet of the second inter-refrigerant heat exchanger in a state of C2.

Then, the main part of the refrigerant is decompressed and expanded, and enters the evaporator in a state of D2. The main part thereof merges with the refrigerant at evaporation-side outlet Es of the second inter-refrigerant heat exchanger through evaporator outlet E, and is guided to compressor suction A2.

At this time, there are two cycles of the main part of the refrigerant that flows in order of A2→B2→C→C2→D2→E→A2 and the sub-refrigerant that flows in order of A2→B2→C→Ds→Es→A2.

The flow of the main part of the refrigerant causes a long path in many cases and thus is likely to have a large pressure loss. For this reason, using the second inter-refrigerant heat exchanger reduces the amount of circulation of the flow of the main part of the refrigerant, so that the pressure loss decreases to lead improvement in operation efficiency.

The flow of the sub-refrigerant can also form an injection cycle to improve operation efficiency. The flow of the sub-refrigerant further uses cold-heat from a start of evaporation. Thus, while the evaporation side of the refrigerant heat exchanger has a minimum temperature of 22° C. in FIG. 2 when only the first inter-refrigerant heat exchanger is used, a temperature less than or equal to 14° C. can be obtained in FIG. 3.

Here, the present inventors have reached the idea that an excellent effect can be obtained by not only using the first inter-refrigerant heat exchanger or the second inter-refrigerant heat exchanger alone but also combining the first inter-refrigerant heat exchanger and the second inter-refrigerant heat exchanger to form a cycle.

Then, the present disclosure provides an air conditioner that is inexpensive and excellent not only in operation efficiency but also in comfort and reliability, and that includes a refrigerant circuit that circulates a refrigerant and is formed with pipes connecting a compressor that compresses the refrigerant, a condenser that exchanges heat of the refrigerant with air fed by a first blower to condense the refrigerant, and an evaporator that exchanges heat of the refrigerant with air fed by a second blower to evaporate the refrigerant, the air conditioner including: a branch part that distributes the refrigerant having flowed out of the condenser into a main circuit communicating with the evaporator and a bypass circuit that bypasses the evaporator; a confluence part that merges the refrigerant from the main circuit and the refrigerant from the bypass circuit; a first throttle that decompresses and expands the refrigerant between the condenser and the evaporator; and a first inter-refrigerant heat exchanger that exchanges heat between the refrigerant between the condenser and the first throttle, and the refrigerant between the confluence part and suction into the compressor, the bypass circuit including a second throttle that decompresses and expands the refrigerant distributed by the branch part, and a second inter-refrigerant heat exchanger that exchanges heat of the distributed refrigerant with a refrigerant having flowed out of a condensation-side outlet of the first inter-refrigerant heat exchanger, the distributed refrigerant being configured to merge with a refrigerant having flowed from the evaporator, in the branch part.

Exemplary embodiments will be described in detail below with reference to the drawings. Unnecessary detailed description may not be described. For example, a detailed description of already well-known matters or a duplicated description of a substantially identical configuration may not be described.

The accompanying drawings and the following description are only presented to help those skilled in the art fully understand the present disclosure and are not intended to limit the subject matters described in the scope of claims.

First Exemplary Embodiment

A first exemplary embodiment will be described below with reference to FIG. 1.

[1-1. Configuration]

Figure 1:
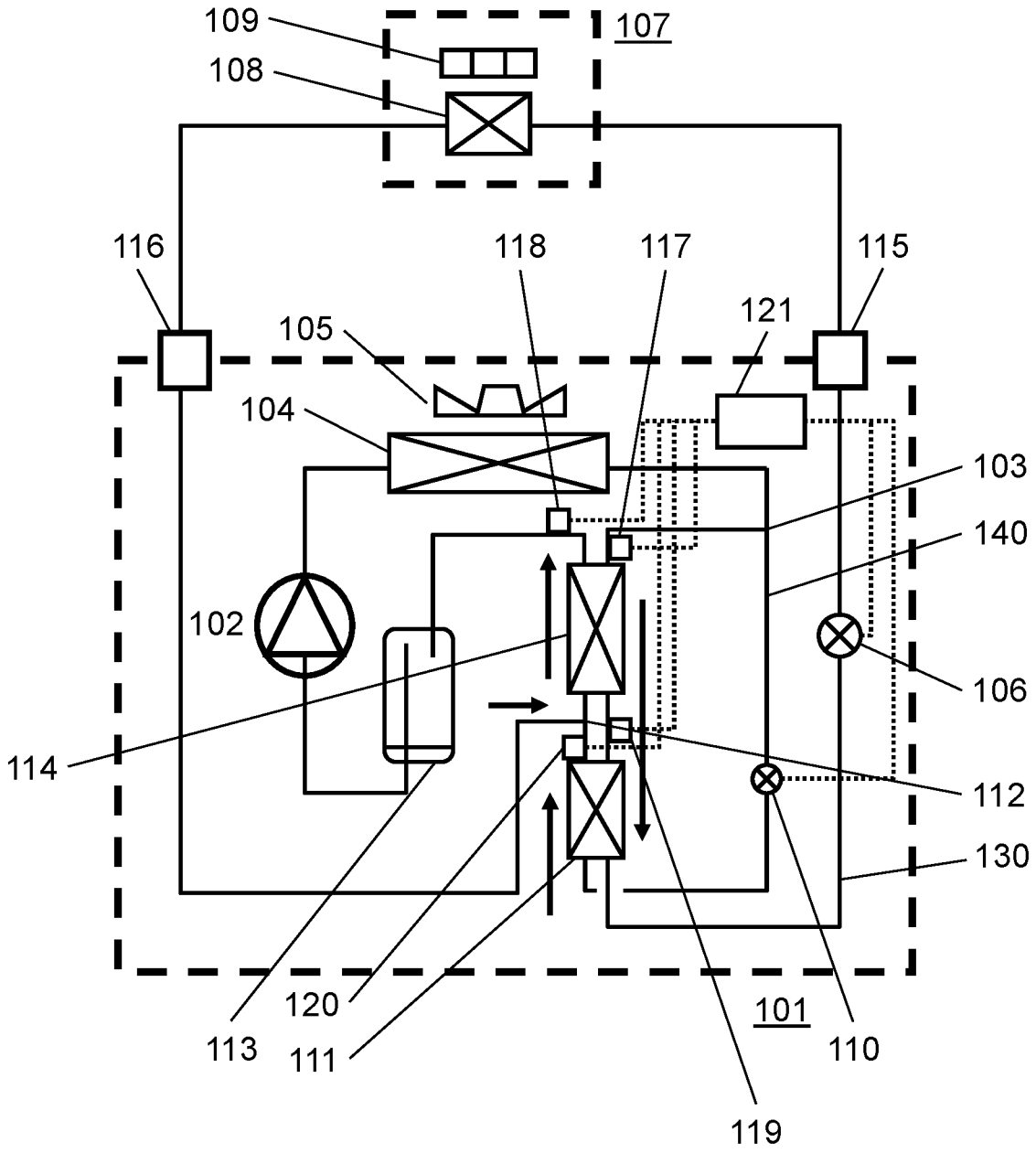
FIG. 1 is a diagram illustrating a configuration of an air conditioner according to a first exemplary embodiment of the present disclosure.

FIG. 1 illustrates outdoor unit 101 of an air conditioner according to the first exemplary embodiment, outdoor unit 101 including compressor 102, accumulator 113, outdoor heat exchanger 104 that is a condenser, outdoor fan 105 that is a first blower, main expansion valve 106 that is a first throttle, bypass circuit 140, sub expansion valve 110 that is a second throttle, first inter-refrigerant heat exchanger 114, second inter-refrigerant heat exchanger 111, condensation-side inlet temperature detector 117, evaporation-side outlet temperature detector 118, condensation-side intermediate temperature detector 119, evaporation-side intermediate temperature detector 120, and controller 121.

Indoor unit 107 includes indoor heat exchanger 108 that is an evaporator and indoor fan 109 that is a second air blower.

Outdoor unit 101 and indoor unit 107 are connected by piping using liquid-side connection port 115 and gas-side connection port 116.

Specifically, a refrigerant used in the first exemplary embodiment is R454C, and may be R22, R407C, R410A, R32, R1234yf, or a mixed refrigerant thereof. The mixed refrigerant may be a non-azeotropic mixed refrigerant, and particularly using a mixed refrigerant of R1234yf and R32 is preferable, the mixed refrigerant containing R1234yf at a weight ratio of more than or equal to 70%.

A refrigerant circuit of the first exemplary embodiment includes main circuit 130 formed annularly with refrigerant pipes connecting accumulator 113, compressor 102, outdoor heat exchanger 104, first inter-refrigerant heat exchanger 114, second inter-refrigerant heat exchanger 111, main expansion valve 106, and indoor heat exchanger 108.

Bypass circuit 140 is a pipe through which a part of the refrigerant having flowed out of outdoor heat exchanger 104 is bypassed and guided to a suction side of compressor 102. Bypass circuit 140 is connected at one end to branch part 103 of the pipe between outdoor heat exchanger 104 and first inter-refrigerant heat exchanger 114, and at the other end to confluence part 112 of the pipe between an evaporation-side outlet of second inter-refrigerant heat exchanger 111 and an evaporation-side inlet of first inter-refrigerant heat exchanger 114. Branch part 103 is configured to distribute a part of the refrigerant having flowed out of outdoor heat exchanger 104. Branch part 103 may be disposed at any one of a position between outdoor heat exchanger 104 and first inter-refrigerant heat exchanger 114, a position between a condensation-side outlet of first inter-refrigerant heat exchanger 114 and a condensation-side inlet of second inter-refrigerant heat exchanger 111, and a position between a condensation-side outlet of second inter-refrigerant heat exchanger 111 and main expansion valve 106. Confluence part 112 is configured to cause the refrigerant having flowed out of the evaporation-side outlet of second inter-refrigerant heat exchanger 111 to merge with the refrigerant having flowed out of indoor heat exchanger 108. Bypass circuit 140 is provided with sub expansion valve 110 serving as a second throttle to decompress and expand the refrigerant distributed at branch part 103. Sub expansion valve 110 is connected to a pipe at the evaporation-side inlet of second inter-refrigerant heat exchanger 111.

First inter-refrigerant heat exchanger 114 and second inter-refrigerant heat exchanger 111 are configured to exchange heat between the refrigerant on a condensation side and the refrigerant on an evaporation side. The refrigerant on the condensation side and the refrigerant on the evaporation side are configured to flow in respective directions opposite of each other.

First inter-refrigerant heat exchanger 114 includes a condensation-side inlet connected to an outlet of outdoor heat exchanger 104, a condensation-side outlet connected to the condensation-side inlet of second inter-refrigerant heat exchanger 111, an evaporation-side inlet connected to confluence part 112, and an evaporation-side outlet connected to accumulator 113.

Second inter-refrigerant heat exchanger 111 includes the condensation-side inlet connected to the condensation-side outlet of first inter-refrigerant heat exchanger 114, the condensation-side outlet connected to main expansion valve 106, the evaporation-side inlet connected to sub expansion valve 110, and the evaporation-side outlet connected to confluence part 112.

Compressor 102 compresses the refrigerant having flowed in from corresponding one of the refrigerant pipes. Compressor 102 is rotationally driven by a compressor motor, and the compressor motor can be changed in frequency (rotation speed) by an inverter. Compressor 102 is connected on its suction side to the refrigerant pipe from accumulator 113, and on its discharge side to the refrigerant pipe to outdoor heat exchanger 104.

Main expansion valve 106 is connected on its outlet side to an inlet of indoor heat exchanger 108 through liquid-side connection port 115.

Condensation-side inlet temperature detector 117, evaporation-side outlet temperature detector 118, condensation-side intermediate temperature detector 119, and evaporation-side intermediate temperature detector 120 are disposed to detect temperature of the refrigerant at the condensation-side inlet of first inter-refrigerant heat exchanger 114, temperature of the refrigerant at the evaporation-side outlet of first inter-refrigerant heat exchanger 114, temperature of the refrigerant at the condensation-side inlet of second inter-refrigerant heat exchanger 111, and temperature of the refrigerant at the evaporation-side outlet of second inter-refrigerant heat exchanger 111, respectively.

Controller 121 controls an opening degree of each of main expansion valve 106 and sub expansion valve 110 based on the temperatures detected by condensation-side inlet temperature detector 117, evaporation-side outlet temperature detector 118, condensation-side intermediate temperature detector 119, and evaporation-side intermediate temperature detector 120. Controller 121 includes a processor and a memory, and the processor executes a program stored in the memory to implement functions of controller 121. Although the program to be executed by the processor is here to be recorded in advance in the memory, the control program may be provided by being recorded in a non-temporary recording medium such as a memory card, or may be provided through a telecommunication line such as the Internet. Alternatively, controller 121 may be a dedicated hardware circuit that implements the functions described above.

Although the air conditioner of the first exemplary embodiment has a configuration dedicated to cooling, a similar effect can be still obtained even in a configuration for both cooling and heating.

[1-2. Operation]

Operation and effect of the air conditioner according to the first exemplary embodiment configured as described above will be described below.

Figure 4:
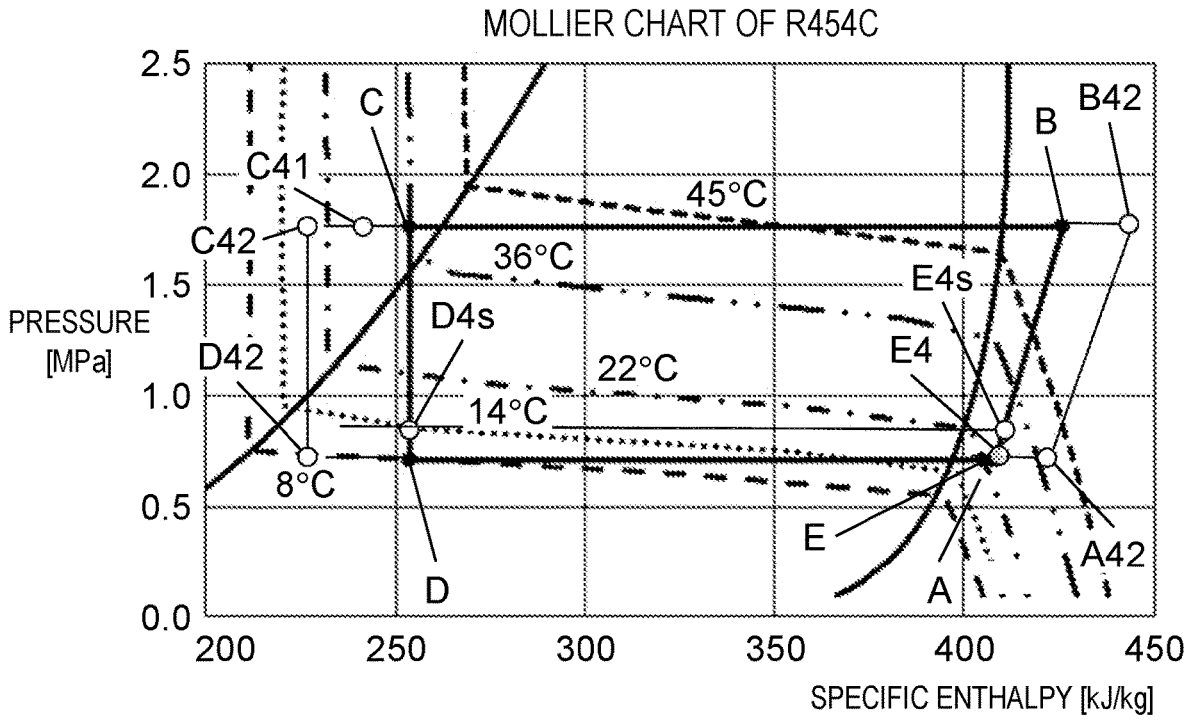
FIG. 4 is a Mollier chart of R454C showing a state of a refrigeration cycle according to the first exemplary embodiment.

The air conditioner according to the first exemplary embodiment includes two paths of main circuit 130 and bypass circuit 140 through which the refrigerant flows. The circuits of the refrigerant according to the present exemplary embodiment will be described with reference to the Mollier chart of R454C in FIG. 4 showing a state of a refrigeration cycle according to the first exemplary embodiment.

Main circuit 130 includes the following in order: suction (A42) of compressor 102→discharge (B42) of compressor 102→outlet (C) of outdoor heat exchanger 104→condensation-side outlet (C41) of first inter-refrigerant heat exchanger 114→condensation-side outlet (C42) of second inter-refrigerant heat exchanger 111→main expansion valve 106→inlet (D42) of indoor heat exchanger 108→outlet (E) of indoor heat exchanger 108→evaporation-side inlet (E4) of first inter-refrigerant heat exchanger 114→suction (A42) of compressor 102.

Bypass circuit 140 includes the following in order: suction (A42) of compressor 102→discharge (B42) of compressor 102→outlet (C) of outdoor heat exchanger 104→sub expansion valve 110→evaporation-side inlet (D4s) of second inter-refrigerant heat exchanger 111→evaporation-side outlet (E4s) of second inter-refrigerant heat exchanger 111→evaporation-side inlet (E4) of first inter-refrigerant heat exchanger 114→suction (A42) of compressor 102.

First inter-refrigerant heat exchanger 114 cools the refrigerant having flowed out of outdoor heat exchanger 104 from a state of C to a state of C41 on the condensation side. First inter-refrigerant heat exchanger 114 also heats the refrigerant having flowed in from indoor heat exchanger 108 and the evaporation side of second inter-refrigerant heat exchanger 111 from a state of E4 to a state of A42 on the evaporation side.

The second inter-refrigerant heat exchanger cools the refrigerant having flowed out of the condensation side of first inter-refrigerant heat exchanger 114 from the state of C41 to a state of C42 on the condensation side. The second inter-refrigerant heat exchanger also causes sub expansion valve 110 to partially decompress and expand a part of the refrigerant having flowed out of outdoor heat exchanger 104, and heats the part of the refrigerant from a state of D4s to a state of E4s on the evaporation side.

First inter-refrigerant heat exchanger 114 uses the refrigerant after evaporation (in the second half of the evaporation in some cases) on its evaporation side. In contrast, second inter-refrigerant heat exchanger 111 uses the refrigerant from a start of evaporation on its evaporation side, so that the evaporation side of second inter-refrigerant heat exchanger 111 has the lowest temperature of the refrigerant that is lower than that on the evaporation side of first inter-refrigerant heat exchanger 114 as long as under equal pressure.

Thus, when the refrigerant having flowed out of outdoor heat exchanger 104 is first cooled by the first inter-refrigerant heat exchanger 114 and is next cooled by second inter-refrigerant heat exchanger 111 in order as in the first exemplary embodiment, the heat exchange of the refrigerant can be continuously and efficiently performed as in order of C→C41→C42 in FIG. 4.

Here, even when first inter-refrigerant heat exchanger 114 is enlarged to increase the amount of heat exchange of the refrigerant by using only first inter-refrigerant heat exchanger 114, temperature of the refrigerant at C41 does not fall below 22° C. because temperature of the refrigerant on the evaporation side does not change from 22° C. at E.

When each of first inter-refrigerant heat exchanger 114 and second inter-refrigerant heat exchanger 111 is configured to cause the refrigerant on the condensation side and the refrigerant on the evaporation side to flow in respective directions opposite of each other as illustrated in FIG. 1, heat exchange efficiency is improved to enable the inter-refrigerant heat exchangers to be downsized.

R454C of a non-azeotropic mixed refrigerant is used as the refrigerant in the first exemplary embodiment, and has a temperature glide. For this reason, a condensation temperature and an evaporation temperature are less likely to be estimated from a temperature of the refrigerant, and thus causing a difficulty in control of an opening degree of the expansion valve by setting a target degree of superheat of the refrigerant sucked or discharged from the compressor. Although the condensation temperature and the evaporation temperature can be estimated using a pressure sensor, there is a concern about an increase in cost.

Controller 121 in the first exemplary embodiment appropriately controls an opening degree of each of main expansion valve 106 and sub expansion valve 110 using the temperatures detected by condensation-side inlet temperature detector 117, evaporation-side outlet temperature detector 118, condensation-side intermediate temperature detector 119, and evaporation-side intermediate temperature detector 120.

When main expansion valve 106 is controlled to reduce an opening degree of main expansion valve 106 from a sufficiently large state, evaporation-side outlet temperature detector 118 detects a temperature changed to a tendency to increase from a state in which the temperature hardly changes or the temperature is in a tendency to gradually decrease. That is, when the refrigerant is changed from a gas-liquid two-phase state to a gas-phase state, the temperature increases rapidly. The best operation performance is exhibited when a temperature difference between a temperature detected by condensation-side inlet temperature detector 117 and a temperature detected by evaporation-side outlet temperature detector 118 is a predetermined value.

When a refrigerant such as R22, R407C, R410A, or R32 is used, the best operation performance can be obtained around when temperature detected by evaporation-side outlet temperature detector 118 starts to increase rapidly. Thus, the opening degree of main expansion valve 106 can be adjusted based on change in temperature detected by evaporation-side outlet temperature detector 118.

R1234yf or a mixed refrigerant containing 70% or more R1234yf, such as R454C, enhances the operation performance when temperature of the refrigerant on the suction side of compressor 102 is close to temperature of the refrigerant detected by condensation-side inlet temperature detector 117.

When sub expansion valve 110 is controlled to reduce an opening degree of sub expansion valve 110 from a sufficiently large state, evaporation-side intermediate temperature detector 120 detects a temperature changed to a tendency to increase from a state in which the temperature hardly changes or the temperature is in a tendency to gradually decrease. That is, when the refrigerant is changed from a gas-liquid two-phase state to a gas-phase state, the temperature increases rapidly. The best operation performance is exhibited when a temperature difference between a temperature detected by condensation-side intermediate temperature detector 119 and a temperature detected by evaporation-side intermediate temperature detector 120 is a predetermined value.

Specific examples of the predetermined value of the temperature difference when R454C is used as a refrigerant under conditions where condenser side air has a dry-bulb temperature of 35° C. and a wet-bulb temperature of 24° C., and evaporator side air has a dry-bulb temperature of 27° C. and a wet-bulb temperature of 19° C., include a value when an inter-refrigerant heat exchanger having a sufficiently large capacity is used, the value being from 3° C. to 6° C. by which temperature at a condensation-side inlet of the inter-refrigerant heat exchanger increases depending on capacity and the like, and a value when an inter-refrigerant heat exchanger having a small capacity is used, the value being from 6° C. to 15° C. by which temperature at a condensation-side inlet of the inter-refrigerant heat exchanger increases depending on capacity and the like.

The predetermined value of an optimum temperature difference between the temperature detected by condensation-side inlet temperature detector 117 and the temperature detected by evaporation-side outlet temperature detector 118, and the predetermined value of an optimum temperature difference between the temperature detected by condensation-side intermediate temperature detector 119 and the temperature detected by evaporation-side intermediate temperature detector 120 vary depending on rotational speed of compressor 102, rotational speed of indoor fan 109, and the like. The predetermined values of the optimal temperature differences may be determined based on the rotational speed of compressor 102 or indoor fan 109.

Although the air conditioner of the first exemplary embodiment illustrated in FIG. 1 is dedicated to cooling, an air conditioner that also performs heating can obtain a similar effect.

[1-3. Effects and the Like]

As described above, the air conditioner according to the present exemplary embodiment includes: compressor 102 that compresses a refrigerant; outdoor heat exchanger 104 that is a condenser configured to exchange heat between the refrigerant and air fed by outdoor fan 105 that is a first blower to condense the refrigerant; indoor heat exchanger 108 that is an evaporator configured to exchange heat between the refrigerant and air fed by indoor fan 109 that is a second blower to evaporate the refrigerant; branch part 103 that causes the refrigerant having flowed out of outdoor heat exchanger 104 to be distributed to main circuit 130 communicating with indoor heat exchanger 108 and bypass circuit 140 bypassing indoor heat exchanger 108; confluence part 112 that merges the refrigerant from main circuit 130 and the refrigerant from bypass circuit 140; main expansion valve 106 that is a first throttle configured to decompress and expand the refrigerant between outdoor heat exchanger 104 and indoor heat exchanger 108; first inter-refrigerant heat exchanger 114 that exchanges heat between a refrigerant between outdoor heat exchanger 104 and main expansion valve 106, and a refrigerant between confluence part 112 and suction of compressor 102; sub expansion valve 110 that is a second throttle disposed in bypass circuit 140 and configured to decompress and expand the refrigerant distributed by branch part 103; and second inter-refrigerant heat exchanger 111 that is disposed in bypass circuit 140 and exchanges heat between the refrigerant decompressed and expanded by sub expansion valve 110 and the refrigerant having flowed out of a condensation-side outlet of first inter-refrigerant heat exchanger 114. Bypass circuit 140 is configured to cause the refrigerant having flowed from second inter-refrigerant heat exchanger 111 to flow to confluence part 112 and merge with the refrigerant having flowed from indoor heat exchanger 108 at confluence part 112.

This configuration causes second inter-refrigerant heat exchanger 111 in which the refrigerant evaporates from a liquid state to have a lower minimum evaporation temperature than first inter-refrigerant heat exchanger 114 that cools the refrigerant at the end of evaporation, and thus enables the refrigerant on a high-pressure side to be cooled to the lowest temperature. Thus, an inexpensive air conditioner with high performance and without using an expensive injection compressor can be provided.

The refrigerant on a low-pressure side having flowed out of second inter-refrigerant heat exchanger 111 can obtain an opportunity to absorb heat again in first inter-refrigerant heat exchanger 114. Thus, the refrigerant is prevented from returning from second inter-refrigerant heat exchanger 111 to the compressor as a liquid refrigerant to enable stable operation, so that an air conditioner with high reliability can be provided.

The refrigerant in the present exemplary embodiment may be a non-azeotropic mixed refrigerant.

First inter-refrigerant heat exchanger 114 and second inter-refrigerant heat exchanger 111 described above compensate for the temperature glide that is a drawback of characteristics of the non-azeotropic mixed refrigerant, so that an inexpensive air conditioner with high performance and high comfort and reliability can be provided.

First inter-refrigerant heat exchanger 114 in the present embodiment may be configured to cause the refrigerant to flow in from outdoor heat exchanger 104 in a direction opposite of that in which the refrigerant flows in from confluence part 112.

This configuration improves heat exchange efficiency of the refrigerant in first inter-refrigerant heat exchanger 114 to increase the amount of heat exchange and reduce temperature of the refrigerant on the high-pressure side, so that an inexpensive air conditioner with high performance and high comfort and reliability can be provided.

Second inter-refrigerant heat exchanger 111 in the present embodiment may be configured to cause the refrigerant to flow in from the condensation-side outlet of first inter-refrigerant heat exchanger 114 in a direction opposite of that in which the refrigerant flows in from sub expansion valve 110.

This configuration improves heat exchange efficiency of the refrigerant in second inter-refrigerant heat exchanger 111 to increase the amount of heat exchange and reduce temperature of the refrigerant on the high-pressure side, so that an inexpensive air conditioner with high performance and high comfort and reliability can be provided.

The air conditioner in the present exemplary embodiment may further include controller 121 that adjusts main expansion valve 106, condensation-side inlet temperature detector 117 that detects temperature of the refrigerant at the condensation-side inlet of first inter-refrigerant heat exchanger 114, and evaporation-side outlet temperature detector 118 that detects temperature of the refrigerant at the evaporation-side outlet of first inter-refrigerant heat exchanger 114. Then, controller 121 may adjust main expansion valve 106 to cause a temperature difference between the temperature of the refrigerant at the condensation-side inlet and the temperature of the refrigerant at the evaporation-side outlet to become a predetermined value by using information on the temperature of the refrigerant detected by condensation-side inlet temperature detector 117 and the temperature of the refrigerant detected by evaporation-side outlet temperature detector 118.

This configuration enables main expansion valve 106 to be easily controlled, and enables improvement in accuracy, reduction in weight of control software, and reduction in work during development, so that an inexpensive device with high accuracy can be achieved. In particular, when a non-azeotropic mixed refrigerant such as R454C is used, a degree of superheating of the refrigerant is not required to be calculated using a pressure sensor or the like. Thus, an inexpensive air conditioner with high performance can be provided.

The air conditioner in the present exemplary embodiment may further include controller 121 that adjusts sub expansion valve 110, condensation-side intermediate temperature detector 119 that detects temperature of the refrigerant at the condensation-side inlet of second inter-refrigerant heat exchanger 111, and evaporation-side intermediate temperature detector 120 that detects temperature of the refrigerant at the evaporation-side outlet of second inter-refrigerant heat exchanger 111. Then, controller 121 may adjust sub expansion valve 110 to cause a temperature difference between a condensation-side intermediate temperature and an evaporation-side intermediate temperature to becomes a predetermined value by using information on the temperature of the refrigerant detected by condensation-side intermediate temperature detector 119 and the temperature of the refrigerant detected by evaporation-side intermediate temperature detector 120.

This configuration enables sub expansion valve 110 to be easily controlled, and enables improvement in accuracy, reduction in weight of control software, and reduction in work during development, so that an inexpensive device with high accuracy can be achieved. In particular, when a non-azeotropic mixed refrigerant such as R454C is used, a degree of superheating of the refrigerant is not required to be calculated using a pressure sensor or the like. Thus, an inexpensive air conditioner with high performance can be provided.

The air conditioner in the present exemplary embodiment may be configured such that at least one of the predetermined value of a difference between the temperature detected by condensation-side inlet temperature detector 117 and the temperature detected by evaporation-side outlet temperature detector 118, and the predetermined value of a difference between the temperature detected by condensation-side intermediate temperature detector 119 and the temperature detected by evaporation-side intermediate temperature detector 120, is adjusted based on at least one of rotational speed of compressor 102 and rotational speed of indoor fan 109.

This configuration enables at least one of main expansion valve 106 and sub expansion valve 110 to set a target suitable for an operation state, so that appropriate throttle control can be performed. Thus, a device with continuous high operation efficiency can be provided.

The refrigerant in the present exemplary embodiment may be a mixed refrigerant of R1234yf and R32 that contains R1234yf at a weight ratio of more than or equal to 70%.

This configuration enables reduction in influence of warming, and enables providing an inexpensive air conditioner with high performance, and high comfort and reliability.

The exemplary embodiment described above is to exemplify the techniques in the present disclosure, and thus, various modifications, replacements, additions, omissions, and the like can be made in the scope of claims or in an equivalent scope of the claims.

INDUSTRIAL APPLICABILITY

The present disclosure is widely applicable to an air conditioner using a refrigerant, and particularly brings a great effect when a refrigerant containing R1234yf at a weight ratio of more than or equal to 70% is used. Specifically, the present disclosure is widely applicable to a room air conditioner, a vending machine, a showcase, and the like.

REFERENCE MARKS IN THE DRAWINGS

101 outdoor unit
102 compressor
103 branch part
104 outdoor heat exchanger (condenser)
105 outdoor fan
106 main expansion valve (first throttle)
107 indoor unit
108 indoor heat exchanger (evaporator)
109 indoor fan
110 sub expansion valve (second throttle)
111 second inter-refrigerant heat exchanger
112 confluence part
113 accumulator
114 first inter-refrigerant heat exchanger
115 liquid-side connection port
116 gas-side connection port
117 condensation-side inlet temperature detector
118 evaporation-side outlet temperature detector
119 condensation-side intermediate temperature detector
120 evaporation-side intermediate temperature detector
121 controller
130 main circuit
140 bypass circuit

The invention claimed is:

1. An air conditioner comprising:

a compressor that compresses a refrigerant;

a condenser that exchanges heat between the refrigerant and air fed by a first blower to condense the refrigerant;

an evaporator that exchanges heat between the refrigerant and air fed by a second blower to evaporate the refrigerant;

a branch part that distributes the refrigerant having flowed out of the condenser into a main circuit communicating with the evaporator and a bypass circuit that bypasses the evaporator;

a confluence part that merges the refrigerant from the main circuit and the refrigerant from the bypass circuit;

a first throttle that decompresses and expands the refrigerant between the condenser and the evaporator;

a first inter-refrigerant heat exchanger that exchanges heat between the refrigerant between the condenser and the first throttle, and the refrigerant between the confluence part and suction into the compressor;

a second throttle that is disposed in the bypass circuit and decompresses and expands the refrigerant distributed at the branch part;

a second inter-refrigerant heat exchanger that is disposed in the bypass circuit and exchanges heat between the refrigerant decompressed and expanded by the second throttle and the refrigerant having flowed out of a condensation-side outlet of the first inter-refrigerant heat exchanger; and an accumulator, wherein the bypass circuit is configured to cause the refrigerant having flowed from the second inter-refrigerant heat exchanger to flow to the confluence part and merge with the refrigerant having flowed from the evaporator at the confluence part, a condensation-side outlet of the first inter-refrigerant heat exchanger is directly connected to a condensation-side inlet of the second inter-refrigerant heat exchanger, and an evaporation-side outlet of the first inter-refrigerant heat exchanger is directly connected to the accumulator, and the accumulator is directly connected to a suction side of the compressor.

2. The air conditioner according to claim 1, wherein the refrigerant is a non-azeotropic mixed refrigerant.

3. The air conditioner according to claim 1, wherein the first inter-refrigerant heat exchanger causes the refrigerant to flow in from the condenser in a direction opposite of a direction in which the refrigerant flows in from the confluence part.

4. The air conditioner according to claim 1, wherein the second inter-refrigerant heat exchanger causes the refrigerant to flow in from the condensation-side outlet of first inter-refrigerant heat exchanger in a direction opposite of a direction in which the refrigerant flows in from the second throttle.

5. The air conditioner according to claim 1, wherein the refrigerant is a mixed refrigerant of R1234yf and R32 that contains R1234yf at a weight ratio of more than or equal to 70%.

6. An air conditioner comprising:

a compressor that compresses a refrigerant;

a condenser that exchanges heat between the refrigerant and air fed by a first blower to condense the refrigerant;

an evaporator that exchanges heat between the refrigerant and air fed by a second blower to evaporate the refrigerant;

a branch part that distributes the refrigerant having flowed out of the condenser into a main circuit communicating with the evaporator and a bypass circuit that bypasses the evaporator;

a confluence part that merges the refrigerant from the main circuit and the refrigerant from the bypass circuit;

a first throttle that decompresses and expands the refrigerant between the condenser and the evaporator;

a first inter-refrigerant heat exchanger that exchanges heat between the refrigerant between the condenser and the first throttle, and the refrigerant between the confluence part and suction into the compressor;

a second throttle that is disposed in the bypass circuit and decompresses and expands the refrigerant distributed at the branch part; and a second inter-refrigerant heat exchanger that is disposed in the bypass circuit and exchanges heat between the refrigerant decompressed and expanded by the second throttle and the refrigerant having flowed out of a condensation-side outlet of the first inter-refrigerant heat exchanger, wherein the bypass circuit is configured to cause the refrigerant having flowed from the second inter-refrigerant heat exchanger to flow to the confluence part and merge with the refrigerant having flowed from the evaporator at the confluence part, the air conditioner further comprising:

a controller that adjusts the first throttle;

a condensation-side inlet temperature detector that detects temperature of the refrigerant at a condensation-side inlet of the first inter-refrigerant heat exchanger; and an evaporation-side outlet temperature detector that detects temperature of the refrigerant at an evaporation-side outlet of the first inter-refrigerant heat exchanger, wherein the controller adjusts the first throttle by using information on the temperature of the refrigerant detected by the condensation-side inlet temperature detector and the temperature of the refrigerant detected by the evaporation-side outlet temperature detector.

7. The air conditioner according to claim 6, wherein the controller adjusts the first throttle to cause a temperature difference between the temperature of the refrigerant at the condensation-side inlet and the temperature of the refrigerant at the evaporation-side outlet to become a predetermined value by using information on the temperature of the refrigerant detected by the condensation-side inlet temperature detector and the temperature of the refrigerant detected by the evaporation-side outlet temperature detector.

8. The air conditioner according to claim 7, wherein the predetermined value is determined based on rotational speed of the compressor.

9. An air conditioner comprising:

a compressor that compresses a refrigerant;

a condenser that exchanges heat between the refrigerant and air fed by a first blower to condense the refrigerant;

an evaporator that exchanges heat between the refrigerant and air fed by a second blower to evaporate the refrigerant;

a branch part that distributes the refrigerant having flowed out of the condenser into a main circuit communicating with the evaporator and a bypass circuit that bypasses the evaporator;

a confluence part that merges the refrigerant from the main circuit and the refrigerant from the bypass circuit;

a first throttle that decompresses and expands the refrigerant between the condenser and the evaporator;

a first inter-refrigerant heat exchanger that exchanges heat between the refrigerant between the condenser and the first throttle, and the refrigerant between the confluence part and suction into the compressor;

a second throttle that is disposed in the bypass circuit and decompresses and expands the refrigerant distributed at the branch part; and a second inter-refrigerant heat exchanger that is disposed in the bypass circuit and exchanges heat between the refrigerant decompressed and expanded by the second throttle and the refrigerant having flowed out of a condensation-side outlet of the first inter-refrigerant heat exchanger, wherein the bypass circuit is configured to cause the refrigerant having flowed from the second inter-refrigerant heat exchanger to flow to the confluence part and merge with the refrigerant having flowed from the evaporator at the confluence part, the air conditioner further comprising:

a controller that adjusts the second throttle;

a condensation-side intermediate temperature detector that detects temperature of the refrigerant at the condensation-side inlet of the second inter-refrigerant heat exchanger; and an evaporation-side intermediate temperature detector that detects temperature of the refrigerant at the evaporation-side outlet of the second inter-refrigerant heat exchanger, wherein the controller adjusts the second throttle by using information on the temperature of the refrigerant detected by the condensation-side intermediate temperature detector and the temperature of the refrigerant detected by the evaporation-side intermediate temperature detector.

10. The air conditioner according to claim 9, wherein the controller adjusts the second throttle to cause a temperature difference between a condensation-side intermediate temperature and an evaporation-side intermediate temperature to become a predetermined value by using information on the temperature of the refrigerant detected by the condensation-side intermediate temperature detector and the temperature of the refrigerant detected by the evaporation-side intermediate temperature detector.

* * * * *